US006568190B1

(12) United States Patent
Tiemann

(10) Patent No.: US 6,568,190 B1
(45) Date of Patent: May 27, 2003

(54) COMBUSTION CHAMBER ASSEMBLY

(75) Inventor: Carsten Tiemann, Bielefeld (DE)

(73) Assignee: SieMens Aktiengesellschaft, Munich (DE)

( * ) Notice: Subject to any disclaimer, the term of this patent is extended or adjusted under 35 U.S.C. 154(b) by 0 days.

(21) Appl. No.: 09/673,883

(22) PCT Filed: Apr. 19, 1999

(86) PCT No.: PCT/DE99/01169

§ 371 (c)(1),
(2), (4) Date: Apr. 27, 2001

(87) PCT Pub. No.: WO99/56060

PCT Pub. Date: Nov. 4, 1999

(30) Foreign Application Priority Data

Apr. 23, 1998 (DE) ..... 198 18 082

(51) Int. Cl.[7] ..... F02C 3/00; F23R 3/50

(52) U.S. Cl. ..... 60/804; 60/725; 60/746; 431/114; 431/175; 431/181

(58) Field of Search ..... 60/804, 737, 746, 60/747, 725, 740, 738; 431/9, 114, 168, 169, 173, 175, 176, 181, 182

(56) References Cited

U.S. PATENT DOCUMENTS

| | | | | |
|---|---|---|---|---|
| 3,729,286 A | | 4/1973 | Iida et al. | |
| 4,967,562 A | | 11/1990 | Shekleton | |
| 5,062,792 A | * | 11/1991 | Maghon | 60/746 |
| 5,156,002 A | * | 10/1992 | Mowill | 60/738 |
| 5,596,873 A | * | 1/1997 | Joshi et al. | 60/738 |
| 5,727,378 A | * | 3/1998 | Seymour | 60/804 |
| 6,056,538 A | * | 5/2000 | Buchner et al. | 431/115 |
| 6,360,525 B1 | * | 3/2002 | Senior et al. | 60/747 |
| 6,425,239 B2 | * | 7/2002 | Hoffmann et al. | 60/746 |

FOREIGN PATENT DOCUMENTS

| | | |
|---|---|---|
| DE | 4339094 A1 | 5/1995 |
| DE | 19541303 A1 | 5/1997 |
| DE | 19615910 A1 | 10/1997 |

* cited by examiner

*Primary Examiner*—Ted Kim
(74) *Attorney, Agent, or Firm*—Harness, Dickey & Pierce P.L.C.

(57) ABSTRACT

In a combustion chamber arrangement, especially an annular combustion chamber arrangement for a gas turbine, one or more burners has, at its mouth, a deflecting device by which a combustion chamber arrangement is deflected. This achieves the effect of acoustic detuning, whereby the formation of a combustion oscillation is suppressed.

20 Claims, 6 Drawing Sheets

COMBUSTION CHAMBER ASSEMBLY

This application is the national phase under 35 U.S.C. §371 of PCT International Application No. PCT/DE99/01169 which has an International filing date of Apr. 19, 1999, which designated the United States of America.

FIELD OF THE INVENTION

The invention relates to a combustion chamber arrangement with a combustion chamber in which a burner is arranged. The combustion chamber is especially an annular combustion chamber of a gas turbine.

BACKGROUND OF THE INVENTION

DE 195 41 303 A1 discloses a combustion chamber arrangement of a gas turbine into which a number of burners open. The gas turbine has a turbine shaft with a main axis. Each burner is directed along a main axis. To achieve particularly high efficiency, the main axis of each burner is tilted with respect to the main axis of the turbine shaft for producing a swirl of a working medium. Such a tilting of the burners dispenses with the need for a swirl-producing structural part.

In DE 43 39 094 A1 there is a description of a method of damping thermoacoustic oscillations in the combustion chamber of a gas turbine. In the combustion of fuels in the combustion chamber of an industrial gas turbine, an aircraft engine or the like, the combustion processes can cause instabilities or pressure fluctuations which, under unfavorable conditions, induce thermoacoustic oscillations, which are also referred to as combustion oscillations. These not only represent an undesired source of noise, they also lead to inadmissibly high mechanical loads on the combustion chamber. Such a thermoacoustic oscillation is actively damped by the location of the fluctuation in heat release associated with the combustion being controlled by injecting a fluid.

U.S. Pat. No. 4,967,562 discloses a turbine engine in which particularly good fuel distribution in the combustion air is achieved. This is realized by fuel being injected from a nozzle onto a baffle plate. As this happens, the fuel is finely atomized and is well distributed in the combustion air which is flowing past the baffle plate.

DE 196 15 910 A1 discloses a burner arrangement, especially for a gas turbine. At least two groups of burners are provided, in each case comprising at least one burner of the same size and geometry for fitting out a combustion chamber. At least one group of burners represents the main burners. The other group of burners is designed as a group of disturbing burners, each of the disturbing burners being inclined with respect to a main burner such that a flame disk formed by the main burner is disturbed in its homogeneity and symmetry. In this way, pressure pulsations can be avoided.

SUMMARY OF THE INVENTION

The object of the invention is to specify a combustion chamber arrangement which has favorable characteristics, especially with regard to the avoidance of thermoacoustic oscillations.

This object is achieved according to the invention by a combustion chamber arrangement with a combustion chamber which has a combustion chamber axis and in which there is arranged a burner which has an opening for a combustion gas stream to flow into the combustion chamber along an opening direction, a deflecting means being arranged in the region of the opening for deflecting the combustion gas stream into an inflow direction which differs from the opening direction and the inflow direction being defined as a unit vector, with a reference point in the opening and a unit length, by three component vectors:

a) an axial component, which is parallel to the combustion chamber axis, b) a planar component, which is perpendicular to the combustion chamber axis and lies in a connecting plane which is defined by the reference point and the combustion chamber axis, c) an orthogonal component, which is perpendicular to the combustion chamber axis and to the planar component.

In such a combustion chamber arrangement, the location of the combustion of the combustion gas flowing out of the burner is shifted by the deflection of the combustion gas stream with the aid of the deflecting means. Such shifting has the consequence that the distances between the location of the combustion and the combustion chamber wall change. As a result, the acoustic system which is formed by the burner and combustion chamber is acoustically detuned. By suitable alignment of the deflecting means, i.e. by suitable selection of the deflecting direction, the formation of a thermoacoustic oscillation can consequently be suppressed.

The combustion chamber is preferably rotationally symmetrical about the combustion chamber axis.

The orthogonal component preferably has a length different from zero. An orthogonal component of the inflow direction different from zero means that the direction of the inflowing combustion gas stream does not lie in the connecting plane, i.e. the inflow direction is turned with respect to the combustion chamber axis. Such oblique flowing in makes shifting of the location of the combustion possible in a particularly efficient way, so that formation of a thermoacoustic oscillation is suppressed.

A further burner is preferably provided, which further burner has an opening for a combustion gas stream to flow into the combustion chamber along a further inflow direction, which further inflow direction is defined as a unit vector, with a further reference point in the opening of the further burner and with the unit length, by three further component vectors:

a) a further axial component, which is parallel to the combustion chamber axis, b) a further planar component, which is perpendicular to the combustion chamber axis and lies in a further connecting plane, which is defined by the further reference point and the combustion chamber axis, c) a further orthogonal component, which is perpendicular to the combustion chamber axis and to the further planar component.

The axial component preferably has a length different from the further axial component. The different lengths of the axial components of the two burners have the consequence that the respective inflow directions of the two burners are inclined or tilted differently with respect to the combustion chamber axis. Such a different inclination of the inflow direction has the effect that the locations of the respective combustion can be set in relation to one another such that combustion oscillations emanating from these locations disturb or even eliminate one another. In particular, such an arrangement can be used for a combustion chamber with a multiplicity of burners. In this case it is possible for only two burners or else more than two burners to be tilted differently with respect to the combustion chamber axis.

Depending on the geometrical design of the combustion chamber, it is also advantageous to tilt most of the burners or all the burners differently with respect to the combustion chamber axis.

Tilting of a burner or plurality of burners with respect to the combustion chamber axis, manifested by a different length of the axial component of the burners, may also be combined with turning. Such turning corresponds to an orthogonal component different from zero as already referred to above The possibility of simultaneous turning and tilting provides a wide range of possible selections for the shifting of the location of the combustion. This results in a multiplicity of configurations, from which it is possible to select one which ensures acoustic detuning of the acoustic system comprising the combustion chamber and burner, i.e. with which particularly great suppression of thermoacoustic oscillations is achieved. Such a selection may be made, for example, by trying out various configurations and selecting the one with the best thermoacoustic characteristics.

A further deflecting means, for deflecting a combustion gas stream emerging from the further burner into the further inflow direction, is preferably provided in the region of the opening of the further burner.

A combustion of the combustion gas stream from the burner in an energy column and a combustion of the combustion gas stream from the further burner in a further energy column can preferably be produced, which energy columns respectively represent an extension of the combustion gas stream, with the orthogonal component and the further orthogonal component being of such a magnitude and such an orientation that the energy column from the burner and the energy column from the further burner overlap. An energy column is formed by the combustion of the combustion gas stream emerging from the burner, representing one column. Such an arrangement of mutually influencing combustions from two burners leads to a particularly efficient suppression of thermoacoustic oscillations. The overlapping energy columns have the effect that the pressure and power fluctuations which originate from these energy columns and may be the cause of a combustion oscillation also overlap. This overlapping achieves the effect of reducing or suppressing a combustion oscillation.

The deflecting means is preferably a wall protruding into the combustion chamber and surrounding the opening. It is further preferred for the deflecting means to have a breakaway edge for swirls, which can be induced by the combustion gas stream. Such a breakaway edge for swirls has the effect of producing swirls in the combustion gas stream at the deflecting means. These swirls lead to the formation at the deflecting means of a return flow area for the combustion gas stream, in which a location for the combustion is stabilized. Such stabilization allows acoustic detuning of the system to be controlled better. Moreover, fuel and combustion air are mixed still further by the swirling, which favorably also has the additional advantage that $NO_x$ emission is reduced.

The deflecting means is preferably a hollow cylinder or a hollow truncated cone with covering surfaces sloping with respect to each other. These covering surfaces are imaginary surfaces, that is to say not surfaces made solidly of a material. They are formed by the edge of the lateral surface of the hollow cylinder or hollow truncated cone. One covering surface is thus the imaginary connecting surface of the edge facing the opening and the other covering surface is the imaginary connecting surface of the edge protruding into the combustion chamber. This is a particularly simple and effective design of the deflecting means.

The combustion chamber is preferably an annular combustion chamber, especially for a gas turbine. The annular combustion chamber has a complex geometry. In such a system, the occurrence of thermoacoustic oscillations is not predictable and is especially difficult to control. Deflecting means allow even such a system to be acoustically detuned by simple design measures with the result of suppressing thermoacoustic oscillations. The annular combustion chamber preferably has a multiplicity of burners, a deflecting means being arranged in each case in the region of a respective opening for the majority of these burners, in particular for all the burners.

BRIEF DESCRIPTION OF THE DRAWINGS

The invention is explained in more detail by way of example and partly schematically on the basis of the drawing, in which.

DETAILED DESCRIPTION OF PREFERRED EMBODIMENTS

Figure 1:
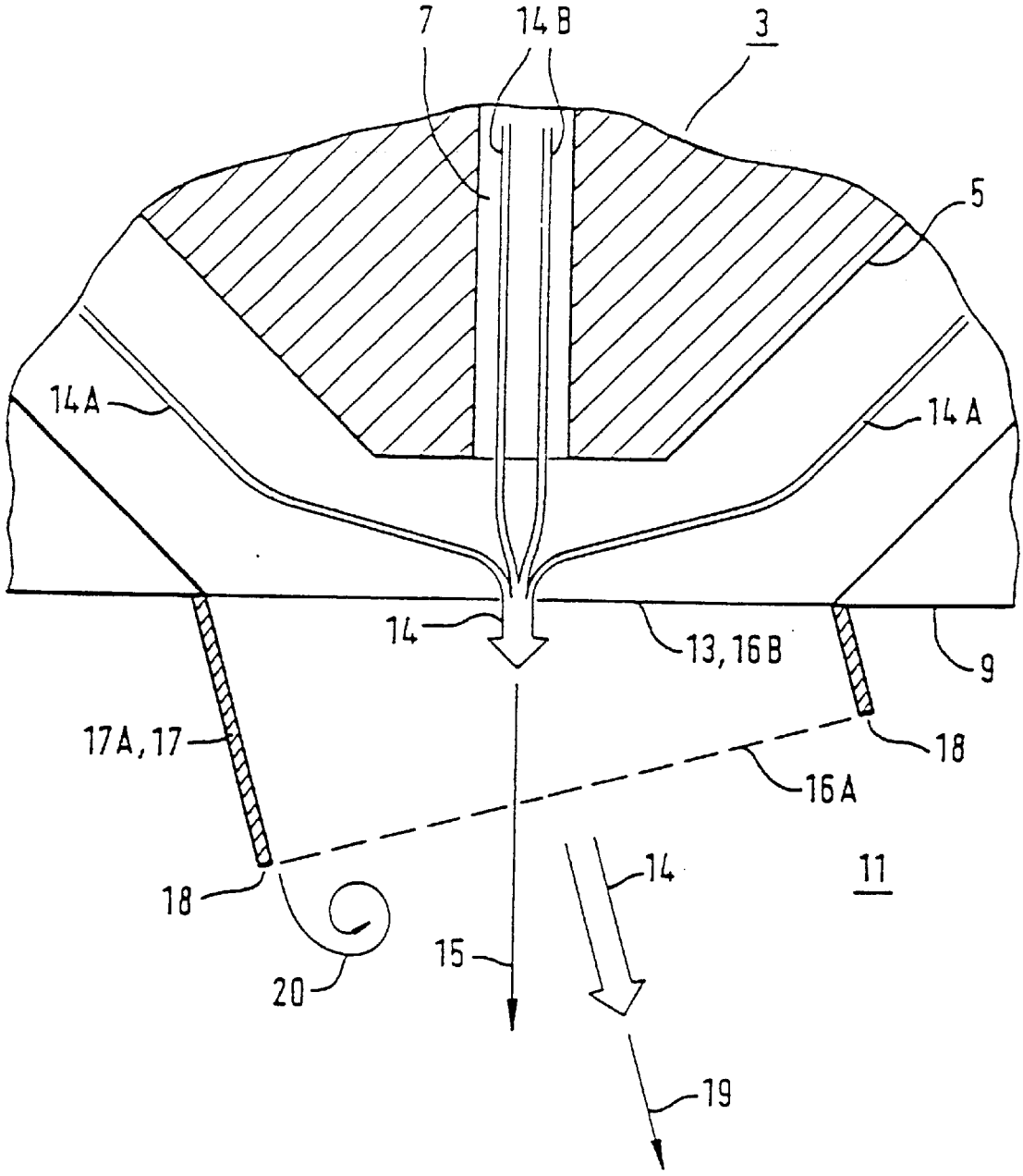
FIG. 1 shows a longitudinal section through a burner with a deflecting means, arranged in a combustion chamber.

The same reference numerals have the same meaning in the various figures.

FIG. 1 shows a longitudinal section through a burner 3. The burner 3 is designed as a hybrid burner, i.e. it has, as a premixing stage, an annular channel 5 which concentrically surrounds a pilot burner 7. The burner is arranged on a combustion chamber wall 9 of a combustion chamber 11. A fuel/air mixture 14A is conducted in the annular channel 5. This mixture joins together with a fuel/air mixture 14B from the pilot burner 7 to form a combustion gas stream 14. The combustion gas stream 14 leaves the burner from an opening 13 a long an opening direction 15. The opening 13 is surrounded by a hollow-cylindrical deflecting means 17, 17A. The deflecting means 17, 17A has imaginary covering surfaces 16A, 16B sloping with respect to each other. The deflecting means is consequently not rotationally symmetrical about the opening direction 15. The deflecting means 17, 17A could also have a preferential direction in cross section, that is to say not a circular cross section as in the example shown here but, for example, an elliptical cross section. It could also be a wall which does not surround the opening 13 completely but only partially. The combustion gas stream 14 is deflected by the deflecting means 17 from the opening direction 15 into an inflow direction 19. The deflecting means 17, 17A has a breakaway edge 18. At this breakaway edge 18, swirls 20 form in the combustion gas stream 14. These swirls 20 have the effect of producing a return flow area for the combustion gas stream 14. This has the consequence that a combustion location is stabilized in these swirls 20. The deflecting means 17, 17A have the effect of shifting the location of the combustion of the combustion gas stream 14 in relation to the combustion chamber wall 9, with respect to an inflow along the opening direction 15. Such shifting has the consequence that the acoustic system which is formed by the burner and combustion chamber is acoustically detuned. Such acoustic detuning results in a suppression of thermoacoustic oscillations. Producing a stable combustion location with the aid of the swirls 20 makes it easier for such acoustic detuning to be controlled.

Figure 2:
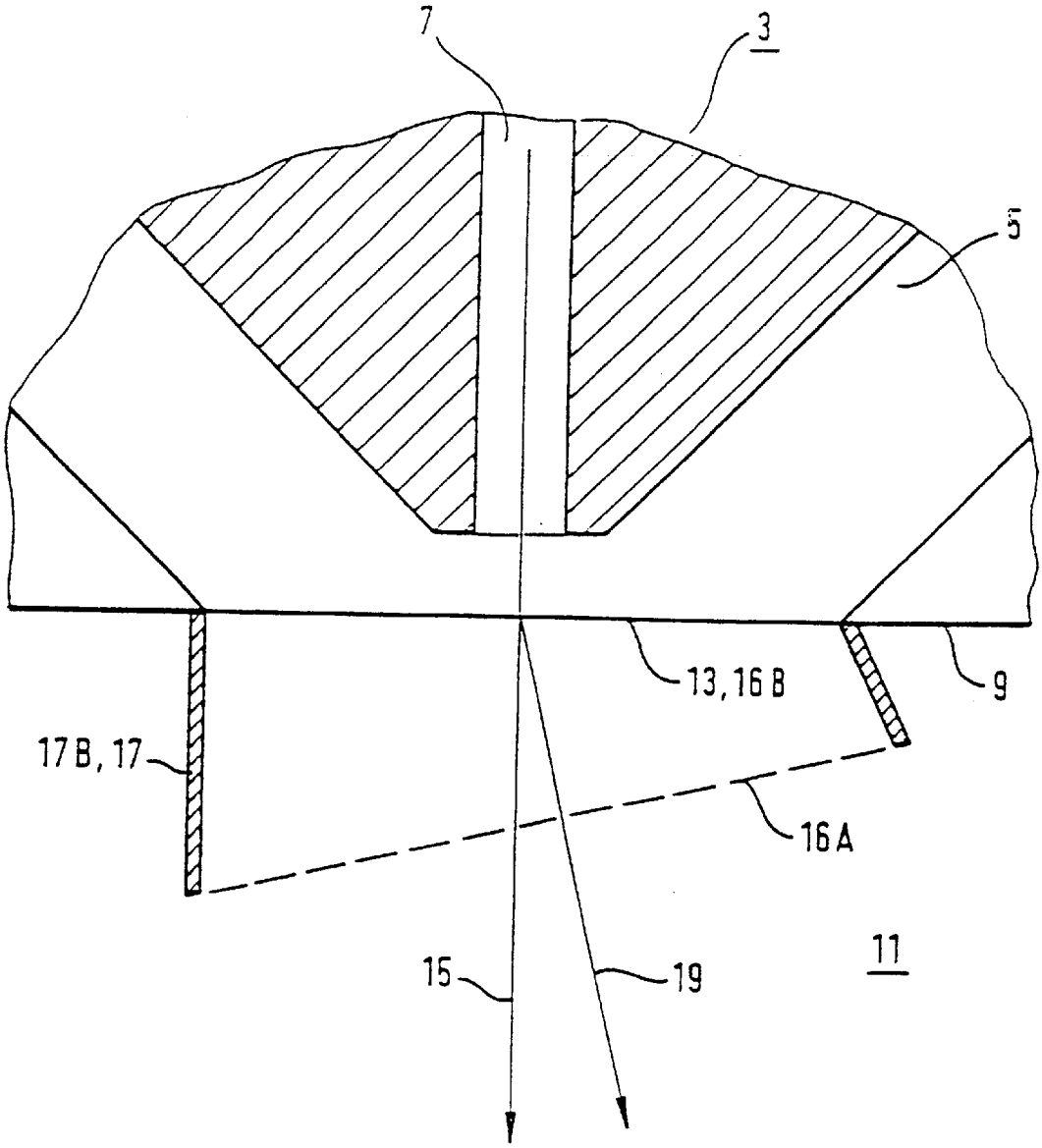
FIG. 2 shows the burner from FIG. 1 with a differently designed deflecting means.

FIG. 2 shows the burner from FIG. 1 with a differently designed deflecting means 17, 17B. This deflecting means 17, 17B is designed as a hollow truncated cone. It likewise has imaginary covering surfaces 16A, 16B sloping with respect to each other. The advantages of this arrangement correspond to the advantages of the arrangement from FIG. 1.

Figure 3:
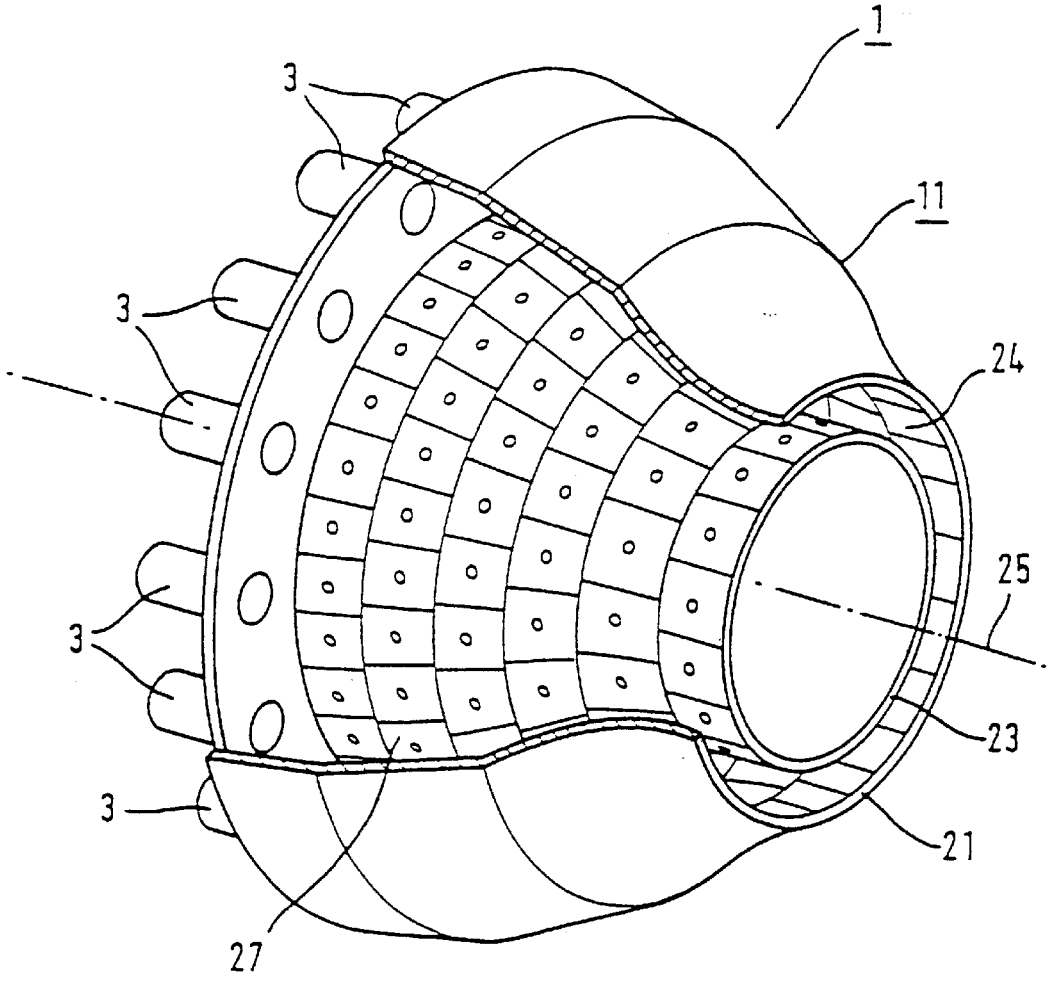
FIG. 3 shows an annular combustion chamber of a gas turbine.

FIG. 3 perspectively shows a combustion chamber arrangement 1, comprising a combustion chamber 11, designed as an annular combustion chamber, of a gas turbine and burners 3 arranged in it along a circumferential direction. The combustion chamber 11 is rotationally symmetrical about a combustion chamber axis 25 and has an outer wall 21 and an inner wall 23. The outer wall 21 and the inner wall 23 enclose an annular combustion space 24. The inner surface of the outer wall 21 and the outer surface of the inner wall 23 are provided with a refractory lining 27.

Figure 4:
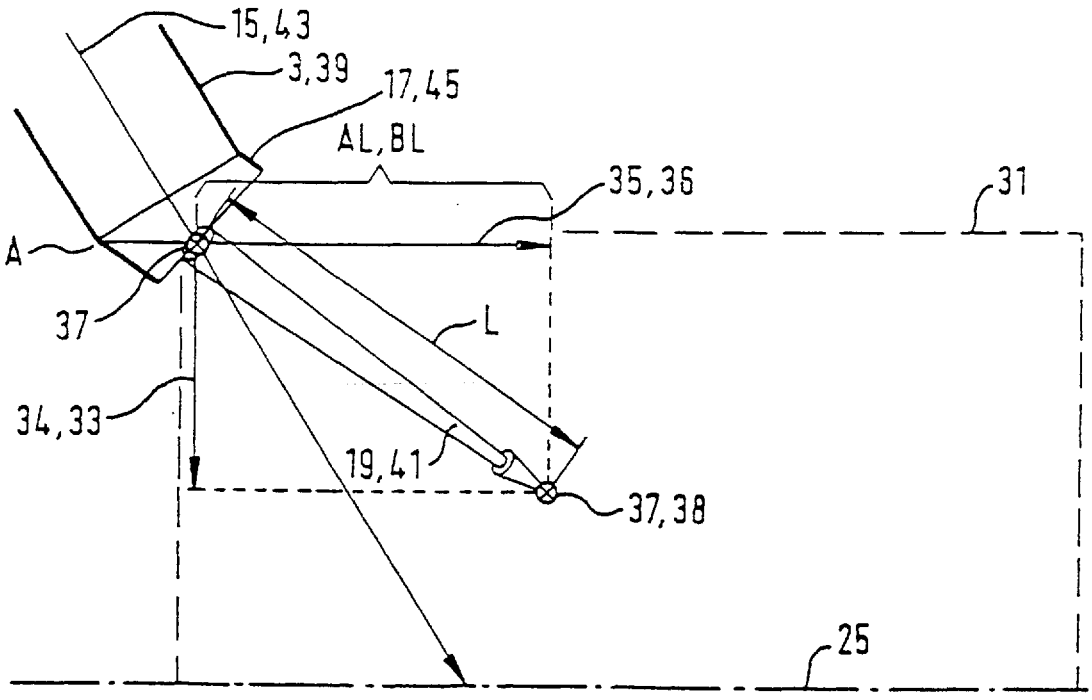
FIG. 4 shows a representation of a component breakdown for an inflow direction.

In FIG. 4 it is shown how the inflow direction 19, 41 can be represented as a unit vector with the unit length L by three components. A burner 3, 39 has an opening direction 15, 43. A deflecting means 17, 45 deflects a combustion gas stream emerging from the burner 3, 39 into an inflow direction 19, 41. This inflow direction 19, 41 is defined by a unit vector taken from a reference point A. The reference point A lies at the centroid of the outer covering surface 16A lying in the combustion chamber. The unit vector has the following three component vectors:

1. An axial component 35, 36, with a length AL, BL, which is parallel to the combustion chamber axis 25.
2. A planar component 33, 34, which is perpendicular to the axial component 35, 36 and lies in a connecting plane 31, defined by the reference point A and the combustion chamber axis 25.
3. An orthogonal component 37, 38, which is perpendicular both to the axial component 35, 36 and to the planar component 33, 34.

This orthogonal component 37, 38 is represented as a circle with a cross, to illustrate that the orthogonal component 37, 38 points into the plane of the drawing.

Figure 5:
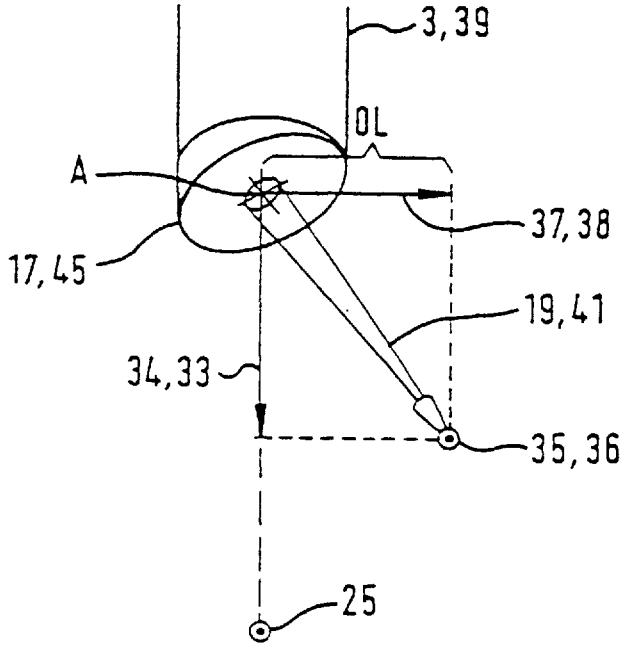
FIG. 5 shows a representation corresponding to FIG. 4 from a different viewing direction.

FIG. 5 shows the burner arrangement of FIG. 4 from a viewing direction along the combustion chamber axis 25. In this representation, the orthogonal component 37, 38 can be seen in its length OL. The axial component 35, 36 points out of the plane of the drawing.

Figure 6:
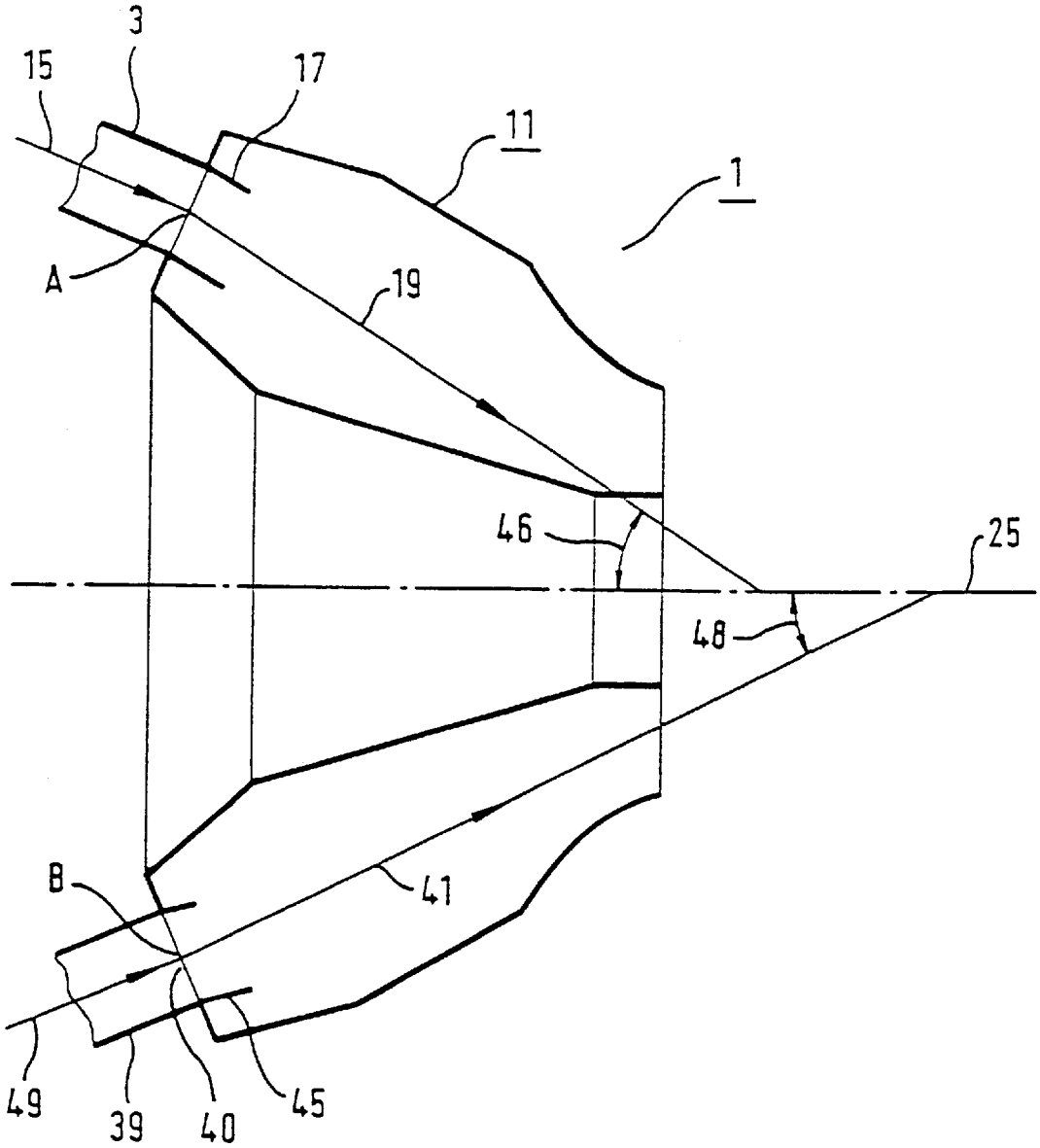
FIG. 6 shows a longitudinal section through an annular combustion chamber of a gas turbine and FIG. 7 shows a cross section through an annular combustion chamber of a gas turbine.

Shown in FIG. 6 is a longitudinal section through a combustion chamber 11, designed as an annular combustion chamber, of a gas turbine (not represented specifically). In the upper half of the longitudinal section, a burner 3 opens into the combustion chamber 11 along an opening direction 15. A combustion gas stream emerging from the burner 3 is deflected into an inflow direction 19 by a deflecting means 17. In the case represented here, the orthogonal component 37 of the inflow direction 19 is zero, so that the inflow direction 19 intersects the combustion chamber axis 25 and forms an angle 46 with the combustion chamber axis 25. In the lower half of the longitudinal section, a further burner 39 opens into the combustion chamber 11 along a further opening direction 49. A combustion gas stream emerging from the further burner 39 is deflected into a further inflow direction 41 by a further deflecting means 45. In the example shown here, the further inflow direction 41 also intersects the combustion chamber axis 25, to be precise at an angle 48. The angle 46 of the inflow direction 19 with the combustion chamber axis 25 is different from the angle 48 of the further inflow direction 41 with the combustion chamber axis 25. This is equivalent to the axial component 35 of the inflow direction 19 having a length AL which differs from that of the further axial component 36 of the further inflow direction 41. The burner 3 and the further burner 39 consequently have inflow directions 19, 41 tilted differently with respect to the combustion chamber axis 25. This different tilting achieves the effect that combustion oscillations which originate from the respective locations of the combustion of combustion gas from the burner 3 or of combustion gas from the further burner 39 overlap such that the acoustic oscillations are suppressed. The case shown here, where the orthogonal component and the further orthogonal component are zero, serves only for simplified representation. The orthogonal component and/or the further orthogonal component may also be different from zero, which corresponds to additional turning of the inflow direction 19 and/or of the further inflow direction 41 with respect to the combustion chamber axis 25.

Figure 7:
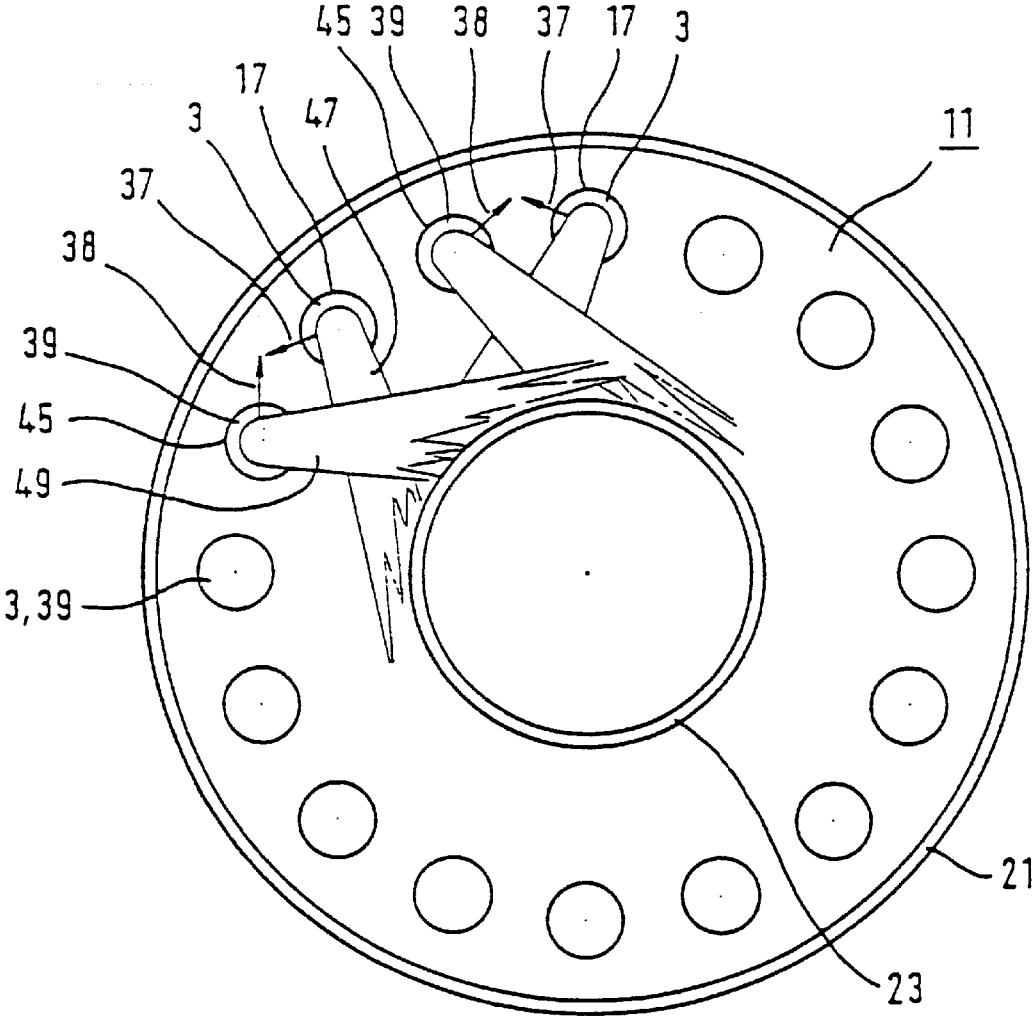

FIG. 7 shows a cross section through a combustion chamber 11, designed as an annular combustion chamber, of a gas turbine. A multiplicity of burners 3, 39 are arranged along a circle. Each of these burners 3, 39 has a deflecting means 17, 45 in the region of its opening. For every two neighboring burners 3, 39, the deflecting means 17, 45 are aligned such that the energy columns 47, 49 respectively forming due to a combustion of the combustion gas emerging from the burner 3, 39 in the manner of a column overlap in pairs. Consequently, the pressure fluctuations which occur in the energy columns 47, 49 and may be the cause of the occurrence of a combustion oscillation also overlap. Such an overlapping has the effect of suppressing the formation of a combustion oscillations.

What is claimed is:

1. A combustion chamber arrangement for a combustion chamber including a combustion chamber axis comprising:

a burner, including an opening through which a combustion gas stream flows into the combustion chamber along an opening direction; and deflecting means, arranged proximate to the opening, for deflecting the combustion gas stream into an inflow direction, which differs from the opening direction, the deflecting means including a wall protruding into the combustion chamber and surrounding the opening, wherein the inflow direction is defined as a unit vector, with a reference point (A) in the opening and a unit length (L), by three.component vectors including, a) an axial component, parallel to the combustion chamber axis, b) a planar component, perpendicular to an axis of symmetry and lying in a connecting plane defined by the reference point (A) and the combustion chamber axis, and c) an orthogonal component, perpendicular to the combustion chamber axis and perpendicular to the planar component.

2. The combustion chamber arrangement as claimed in claim 1, wherein the combustion chamber is rotationally symmetrical about the burner axis.

3. The combustion chamber arrangement as claimed in claim 2, wherein the orthogonal component has a length different from zero.

4. The combustion chamber arrangement as claimed in claim 3, further comprising a further burner, wherein the further burner includes an opening for a combustion gas stream to flow into the combustion chamber along a further inflow direction, the further inflow direction being defined as a unit vector, with a further reference point (B) in the opening of the further burner and with the unit length (L), by three further component vectors including:

a) a further axial component, parallel to the combustion chamber axis, b) a further planar component, perpendicular to the combustion chamber axis and lying in a further connecting plane defined by the further reference point (B) and the combustion chamber axis, and c) a further orthogonal component, perpendicular to the combustion chamber axis and perpendicular to the further planar component.

5. The combustion chamber arrangement as claimed in claim 2, further comprising a further burner, wherein the further burner includes an opening for a combustion gas stream to flow into the combustion chamber along a further inflow direction, the further inflow direction being defined as a unit vector, with a further reference point (B) in the opening of the further burner and with the unit length (L), by three further component vectors including:

a) a further axial component, parallel to the combustion chamber axis, b) a further planar component, perpendicular to the combustion chamber axis and lying in a further connecting plane defined by the further reference point (B) and the combustion chamber axis, and c) a further orthogonal component, perpendicular to the combustion chamber axis and perpendicular to the further planar component.

6. The combustion chamber arrangement as claimed in claim 1, wherein the orthogonal component has a length different from zero.

7. The combustion chamber arrangement as claimed in claim 6, further comprising a further burner, wherein the further burner includes an opening for a combustion gas stream to flow into the combustion chamber along a further inflow direction, the further inflow direction being defined as a unit vector, with a further reference point (B) in the opening of the further burner and with the unit length (L), by three further component vectors including:

a) a further axial component, parallel to the combustion chamber axis, b) a further planar component, perpendicular to the combustion chamber axis and lying in a further connecting plane defined by the further reference point (B) and the combustion chamber axis, and c) a further orthogonal component, perpendicular to the combustion chamber axis and perpendicular to the further planar component.

8. The combustion chamber arrangement as claimed in claim 1, further comprising a further burner, wherein the further burner includes an opening for a combustion gas stream to flow into the combustion chamber along a further inflow direction, the further inflow direction being defined as a unit vector, with a further reference point (B) in the opening of the further burner and with the unit length (L), by three further component vectors including:

a) a further axial component, parallel to the combustion chamber axis, b) a further planar component, perpendicular to the combustion chamber axis and lying in a further connecting plane defined by the further reference point (B) and the combustion chamber axis, and c) a further orthogonal component, perpendicular to the combustion chamber axis and perpendicular to the further planar component.

9. The combustion chamber arrangement as claimed in claim 8, in which the axial component has a length (AL) which is different from a length (BL) of the further axial component.

10. The combustion chamber arrangement as claimed in claim 9, further comprising:

a further deflecting means, for deflecting a combustion gas stream emerging from the further burner into the further inflow direction, provided in the region of the opening of the further burner.

11. The combustion chamber arrangement as claimed in claim 9, in which combustion of the combustion gas stream from the burner in an energy column and a combustion of the combustion gas stream from the further burner in a further energy column can be produced, wherein the energy and further energy columns respectively represent an extension of the combustion gas stream, with the orthogonal component and the further orthogonal component being of such a magnitude and such an orientation that the energy column from the burner and the further energy column from the further burner overlap.

12. The combustion chamber arrangement as claimed in claim 8, further comprising:

a further deflecting means, for deflecting a combustion gas stream emerging from the further burner into the further inflow direction, provided in the region of the opening of the further burner.

13. The combustion chamber arrangement as claimed in claim 12, in which combustion of the combustion gas stream from the burner in an energy column and a combustion of the combustion gas stream from the further burner in a further energy column can be produced, wherein the energy and further energy columns respectively represent an extension of the combustion gas stream, with the orthogonal component and the further orthogonal component being of such a magnitude and such an orientation that the energy column from the burner and the further energy column from the further burner overlap.

14. The combustion chamber arrangement as claimed in claim 8, in which combustion of the combustion gas stream from the burner in an energy column and a combustion of the combustion gas stream from the further burner in a further energy column can be produced, wherein the energy and further energy columns respectively represent an extension of the combustion gas stream, with the orthogonal component and the further orthogonal component being of such a magnitude and such an orientation that the energy column from the burner and the further energy column from the further burner overlap.

15. The combustion chamber arrangement as claimed in claim 1, wherein the deflecting means includes one of a hollow cylinder and a hollow truncated cone with covering surfaces sloping with respect to each other.

16. The combustion chamber arrangement as claimed in claim 1, wherein the deflecting means includes a breakaway edge for swirls, which can be induced by the combustion gas stream.

17. The combustion chamber arrangement as claimed in claim 1, wherein the combustion chamber is an annular combustion chamber.

18. The combustion chamber arrangement of claim 17, wherein the annular combustion chamber is for a gas turbine.

19. The combustion chamber arrangement as claimed in claim 17, including a multiplicity of burners, wherein a deflecting means is arranged in a region of a respective opening of a majority of the burners.

20. The combustion chamber arrangement of claim 19, wherein the deflecting means is arranged in a region of a respective opening of each of the multiplicity of burners.

* * * * *